US009901812B1

(12) United States Patent
Tseng

(10) Patent No.: US 9,901,812 B1
(45) Date of Patent: Feb. 27, 2018

(54) SHUFFLE AND DEAL DEVICE FOR MAHJONG TILES

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 6 days.

(21) Appl. No.: 15/253,883

(22) Filed: Sep. 1, 2016

(51) Int. Cl.
*A63F 9/00* (2006.01)
*A63F 11/00* (2006.01)
*A63F 9/20* (2006.01)

(52) U.S. Cl.
CPC ..... *A63F 11/0002* (2013.01); *A63F 9/20* (2013.01); *A63F 2009/205* (2013.01)

(58) Field of Classification Search
CPC ... A63F 11/0002; A63F 9/20; A63F 2009/205
See application file for complete search history.

(56) References Cited

U.S. PATENT DOCUMENTS 2,203,886 A * 6/1940 Zamora ..... G07C 15/001 273/144 A
2012/0326388 A1* 12/2012 Wang ..... A63F 9/20 273/148 R

* cited by examiner

*Primary Examiner* — Vishu Mendiratta
(74) *Attorney, Agent, or Firm* — Raymond Y. Chan; David and Raymond Patent Firm

(57) ABSTRACT

A shuffle and deal device for mahjong tiles includes mahjong tiles, a shuffle mechanism, and a deal mechanism. Each mahjong tile includes an inner magnet therein. The shuffle mechanism includes a cylinder formed with through holes each provided with a magnet assembly for attracting the inner magnet. The cylinder brings the mahjong tiles to be turned. The deal mechanism includes a tall side board and a short side board. A conveying belt is provided between the tall side board and the short side board. An outer side of the short side board is provided with a guide wheel. A front end of the deal mechanism is inserted in the cylinder. The mahjong tiles are brought by the cylinder to pass the short side board and be blocked by the tall side board to disengage from the magnet assembly and drop on the conveying belt to be delivered out.

7 Claims, 6 Drawing Sheets

SHUFFLE AND DEAL DEVICE FOR MAHJONG TILES

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a shuffle and deal device for mahjong tiles, and more particularly to a device able to shuffle mahjong tiles evenly and output mahjong tiles one by one by means of magnetism.

Description of Related Arts

Mahjong is a puzzle entertainment for all ages, which contains various changes. It is well known that Mahjong is one of the quintessence of Chinese culture. With the developments of technology and network, there are different mahjong games. During a variety of mahjong games, it is necessary to shuffle tiles, stack tiles, and deal tiles. In order to increase the fairness of the mahjong game and to prevent fraud, the players should reduce the chance of touching tiles. Therefore, a mahjong table able to shuffle, stack and retrieve tiles automatically is developed on the market. But, this mahjong table is only suitable to play a traditional mahjong game for four players to sit around the table. If the players want to play different mahjong games, there is no auxiliary product able to shuffle and deal tiles automatically, let alone to cooperate with electronic and computer games. Accordingly, the inventor of the present invention has devoted himself based on his many years of practical experiences to solve this problem.

SUMMARY OF THE PRESENT INVENTION

The primary object of the present invention is to solve the foregoing problems and to provide a shuffle and deal device for mahjong tiles. Each mahjong tile is provided with an inner magnet therein. A circumferential surface of a cylinder of a shuffle mechanism is formed with through holes. An outer side of each through hole is provided with a magnet assembly for attracting the inner magnet of the mahjong tile. The cylinder brings the mahjong tiles to be turned. The mahjong tiles will be blocked by a deal mechanism to drop on a conveying belt to be output one by one for playing a game. The present invention provides an automation function for shuffling and dealing tiles and reduces human intervention.

Another object of the present invention is to provide a shuffle and deal device for mahjong tiles, wherein an outer side of the conveying belt of the deal mechanism is provided with a guide wheel. If the mahjong tile is transversely delivered, one end of the mahjong tile will be blocked by the guide wheel to change its direction. The mahjong tile is brought by the guide wheel which is turned reversely relative to the forward direction of the conveying belt, such that the direction of the mahjong tile can be corrected easily on the conveying belt to be output longitudinally. The present invention provides an automatic correction function for the direction of the mahjong tiles.

DETAILED DESCRIPTION OF THE PREFERRED EMBODIMENT

Figure 1:
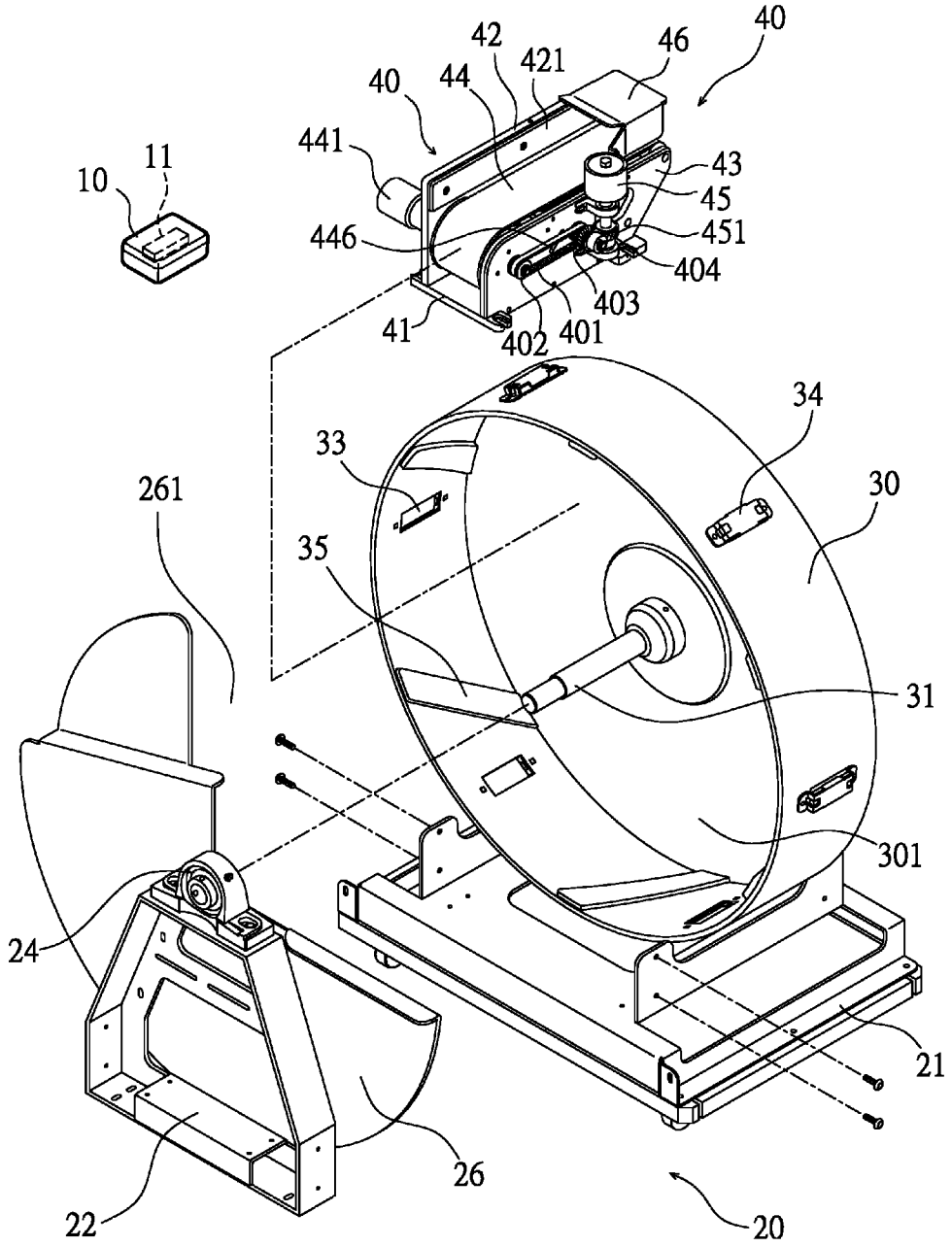
FIG. 1 is an exploded view of the present invention.
Figure 2:
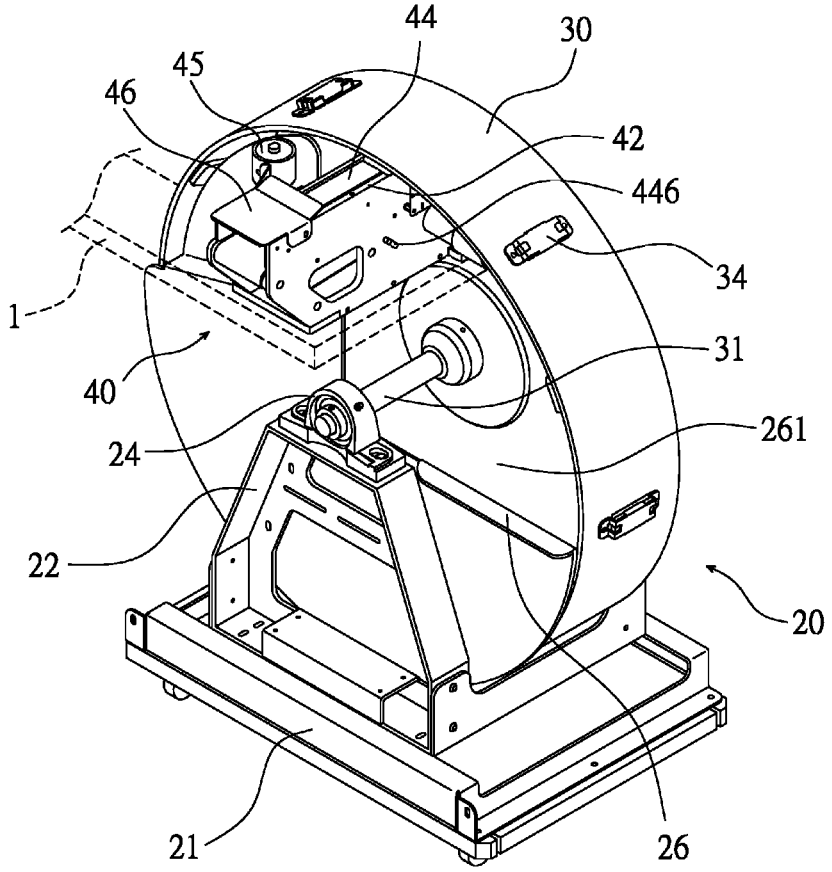
FIG. 2 is a perspective view of the present invention.
Figure 3:
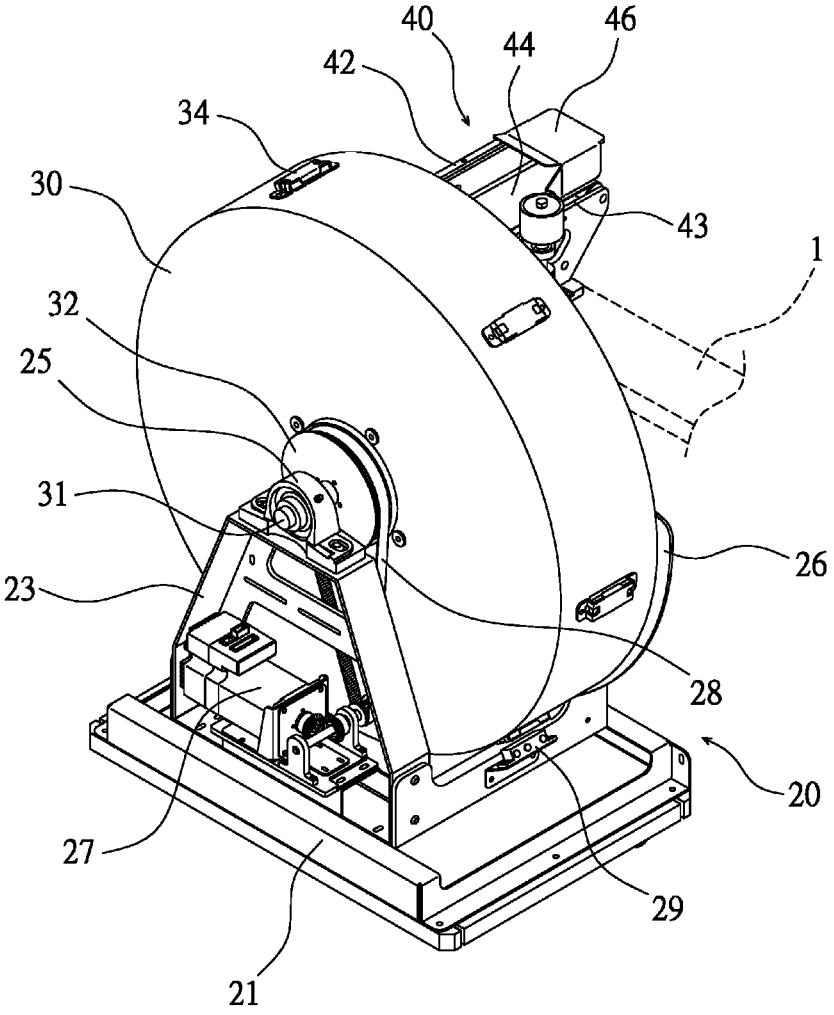
FIG. 3 is a rear perspective view of the present invention.
Figure 4:
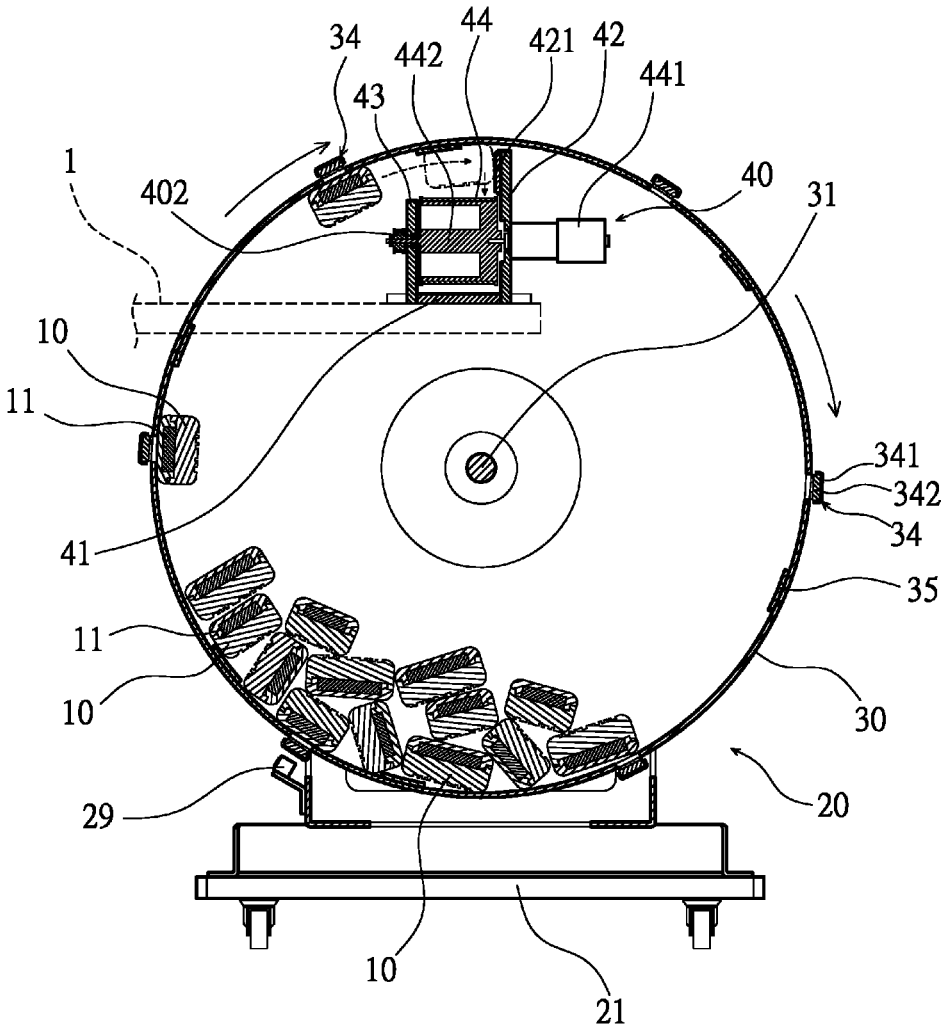
FIG. 4 is a front sectional view of the present invention.

Embodiments of the present invention will now be described, by way of example only, with reference to the accompanying drawings.

As shown in FIG. 1 to FIG. 6, a shuffle and deal device for mahjong tiles of the present invention comprises a plurality of mahjong tiles 10, a shuffle mechanism 20, and a deal mechanism 40. The deal mechanism 40 is coupled on a machine platen 1. Each of the mahjong tiles 10 has a rectangular shape and a face at a bottom thereof and is provided with an inner magnet 11 therein disposed close to a top central portion thereof and extending in a long axis direction thereof. The mahjong tiles 10 are shuffled evenly by the shuffle mechanism 20 and conveyed out one by one through the deal mechanism 40. The shuffle mechanism 20 comprises a base 21, a front side frame 22 and a rear side frame 23 corresponding to each other and disposed on the base 21, and a cylinder 30 having an opening 301 at a front side thereof. A top end of the front side frame 22 is provided with a front bearing seat 24. A top end of the rear side frame 23 is provided with a rear bearing seat 25. The center of the cylinder 30 is provided with a rotatable shaft 31. The rotatable shaft 31 passes through a fluted disk 32 disposed at a rear side of the cylinder 30. The rotatable shaft 31 is connected between the front bearing seat 24 and the rear bearing seat 25. The front side frame 22 is provided with a front cover 26 having a notch 261 to cover the opening 301 of the cylinder 30. The front cover 26 is not in contact with the cylinder 30. The rear side frame 23 is provided with a first motor 27 to drive a first transmission belt 28 fitted on the fluted disk 32 to bring the cylinder 30 to turn. A circumferential surface of the cylinder 30 is formed with a plurality of spaced rectangular through holes 33. An inner side wall of the cylinder 30 is provided with oblique guide boards 35 each disposed between every two of the through holes 33. A long axis direction of the through holes 33 is same as an axial direction of the cylinder 30. An outer side of each through hole 33 is provided with a magnet assembly 34. The magnet assembly 34 includes a fixing member 341 and a magnet 342 wrapped by the fixing member 341 and corresponding to the long axis direction of the through hole 33. The fixing member 341 is coupled to the outer circumferential surface of the cylinder 30. The magnet 342 corresponds to a respective one of the through holes 33 to attract the inner magnet 11 of one of the mahjong tiles 10 in the cylinder 30, enabling the cylinder 30 to bring the attracted mahjong tile 10 to be turned. The base 21 is provided with a reed switch 29. The reed switch 29 is located close to the cylinder 30 to sense the passing of the magnet assembly 34 and detect rotation of the cylinder 30. The deal mechanism 40 includes an elongate bottom board 41. One side of the bottom board 41 in a long axis direction thereof is provided with a tall side board 42, and another side of the bottom board 41 is provided with a short side board 43. An inner side of the tall side board 42 is provided with a smooth plate 421. The bottom board 41 is coupled on the machine platen 1. A second motor 441 is coupled to an outer side of the tall side board 42 to drive a conveying belt 44 provided between the tall side board 42 and the short side board 43. The conveying belt 44 is to surround a drive wheel 442, an upper idle wheel 443, and a lower idle wheel 444. The drive wheel 442 is directly driven by the second motor 441. The tall side board 42 and the short side board 43 are formed with corresponding oblique grooves 446. A tension pulley 445 is connected between the oblique grooves 446 and can be adjusted within the oblique grooves 46. An outer side of the conveying belt 44 passes around the tension pulley 445. An outer side of the short side board 43 is provided with a first outer gear 402. The first outer gear 402 and the drive wheel 442 are turned coaxially. Through a second transmission belt 401, the first outer gear 402 drives a second outer gear 403 and a first helical gear 404 coaxial with the second outer gear 403. The first helical gear 404 meshes with a second helical gear 451. An upper end of the second helical gear 451 is provided with a guide wheel 45. The guide wheel 45 is coaxial with the second helical gear 451 and driven synchronously. A tangential direction of rotation of the guide wheel 5 is opposite to a forwarding direction of the conveying belt 44. The guide wheel 45 protrudes out of a top end of the short side board 43. A leading board 46 is provided over a rear end of the conveying belt 44. The leading board 46 has a flared opening at a front end thereof. An exit 461 is formed between the leading board 46 and the conveying belt 44 for mahjong tiles 10. A front end of the deal mechanism 40 passes through the notch 261 of the cover 26 and is inserted in the cylinder 30, such that the deal mechanism 40 is located at an inner top end of the cylinder 30. The tall side board 42 is not in contact with the cylinder 30. The mahjong tile 10 attracted by the magnet assembly 34 of the cylinder 30 is brought to pass the short side board 43 and be blocked by the tall side board 42 to disengage from the magnet assembly 34 and drop on the conveying belt 44 to be delivered out. Thereby, the mahjong tiles 40 can be output one by one from the cylinder 30, providing an automation function for shuffling and dealing tiles and reducing human intervention.

The details of the assembly of the present invention are described as below. As shown in FIG. 1 to FIG. 6, the components of the present invention, in contact with the mahjong tiles 10, are made of a non-magnetic material, so that the inner magnet 11 of each mahjong tiles 10 won't attract an external object to influence the shuffle and deal of the mahjong tiles 10. The inner magnet 11 is disposed close to the top of the mahjong tile 10, enabling the top of the mahjong tile 10 to possess magnetic attraction and the bottom of the mahjong tile 10 not to possess magnetic attraction. The inner magnets 11 of the mahjong tiles 10 are disposed to have the same magnetic pole at respective upper and lower ends thereof according to the principle that the opposite magnetic poles attract each other and the same magnetic poles are repulsive each other. When the tops of two mahjong tiles 10 approach, they will be repelled apart. This is beneficial to shuffle tiles evenly. The magnetic pole of the magnet 342 of the magnet assembly 34, facing the inside of the cylinder 30, is different from the magnetic pole of the top of the inner magnet 11, so that the magnet assembly 34 can attract and bring the mahjong tile 10 to the top of the cylinder 30. The attracted mahjong tile 10 faces downward and is blocked by the tall side board 42 to drop on the conveying belt 44. Because the mahjong tile 10 faces downward, the player cannot take a peep at the mahjong tile 10. The mahjong tile 10 is attracted by the magnet assembly 34 in the long axis direction, so it will drop on the conveying belt 44 longitudinally. Furthermore, the smooth plate 421 is made of Teflon, so its friction coefficient is low to provide a slippery function. One side of each mahjong tile 10 leans against the smooth plate 421 to decrease friction during conveyance.

Referring to FIG. 1 to FIG. 6, when the present invention is in use, the mahjong tiles 10 are placed into the cylinder 30. The first motor 27 drives the first transmission belt 28 to bring the cylinder 30 to turn. After the cylinder 30 is turned, the oblique boards 35 enables the mahjong tiles 10 to be displaced obliquely and stirred so as to shuffle the mahjong tiles 10 evenly. The magnet assembly 34 of the cylinder 30 attracts the inner magnet 11 of one of the mahjong tiles 10 from the bottom of the cylinder 30. The reed switch 29 detects rotation of the cylinder 30. If the rotation is abnormal (the reed switch 29 detects that the frequency of the magnet assembly 34 passing the reed switch 29 is in the range of errors), it will be determined there is an obstacle to rotation. The motor 27 will be reversely turned a set distance and then continue turning to obviate the obstacle. The mahjong tile 10 attracted by the shuffle mechanism 20 is blocked by the tall side board 42 to drop on the conveying belt 44. The conveying belt 44 is driven by the second motor 441 to deliver the mahjong tiles 10 stably. The tension of the conveying belt 44 can be adjusted by adjusting the position of the tension pulley 445 in the oblique grooves 446.

Figure 5:
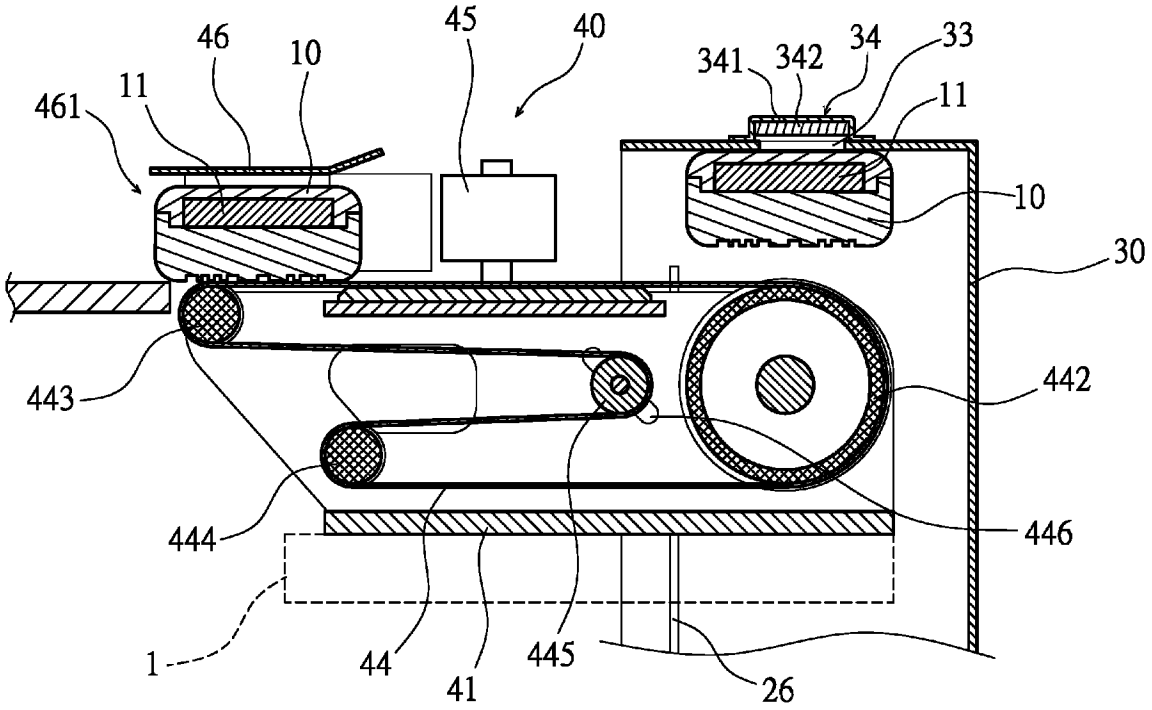
FIG. 5 is a side sectional view of the deal mechanism of the present invention.
Figure 6:
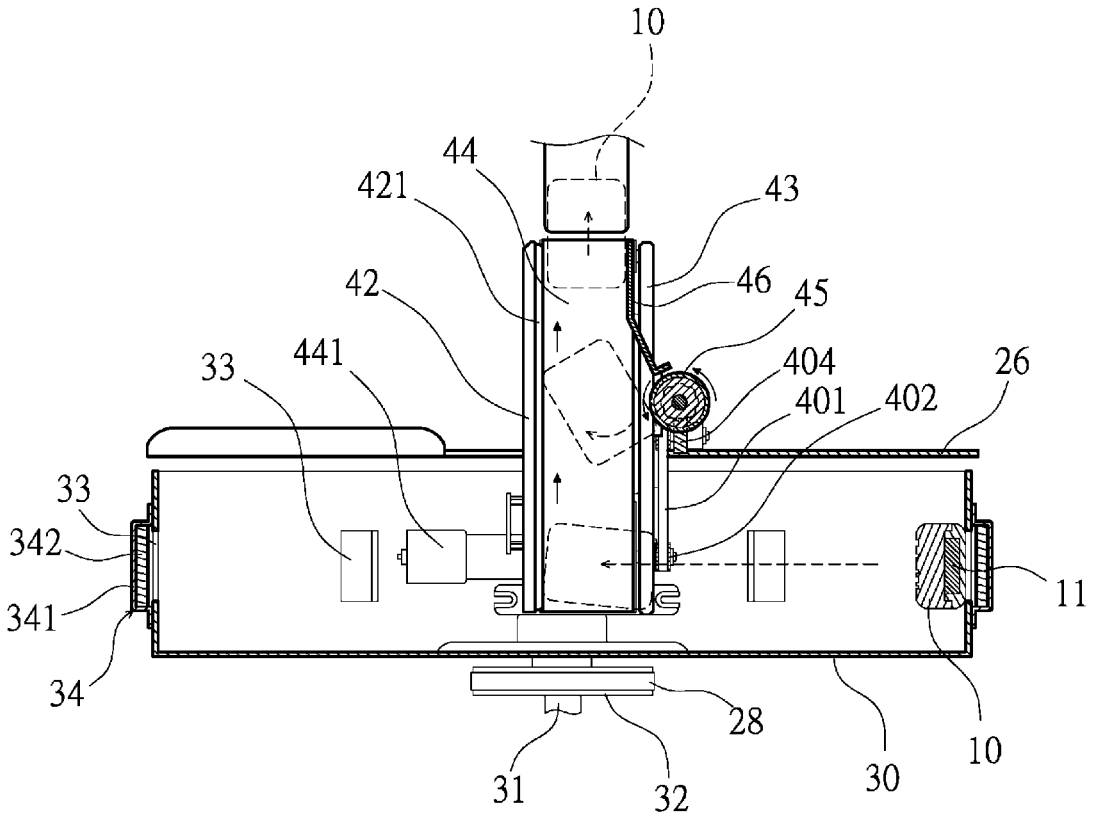
FIG. 6 is a top sectional view of the present invention.

Referring to FIG. 5 and FIG. 6, a distance between an edge of the guide wheel 45 and the tall side board 42 and a width of the exit 461 of the leading board 46 are greater than a length in a short axis direction of the mahjong tile 10, but less than a length in the long axis direction of the mahjong tile 10. If the mahjong tile 10 is transversely delivered (as shown in FIG. 6), one end of the mahjong tile 10 will be blocked by the guide wheel 45 to change its direction. The mahjong tile 10 is brought by the guide wheel 45 which is turned reversely relative to the forward direction of the conveying belt 44, such that the direction of the mahjong tile 10 can be corrected easily on the conveying belt 44 to longitudinally pass through the leading board 46 to be output. The present invention provides an automatic correction function for the direction of the mahjong tiles.

Although particular embodiments of the present invention have been described in detail for purposes of illustration, various modifications and enhancements may be to made without departing from the spirit and scope of the present invention. Accordingly, the present invention is not to be limited except as by the appended claims.

What is claimed is:

1. A shuffle and deal device for mahjong tiles, comprising a plurality of mahjong tiles, a shuffle mechanism, and a deal mechanism, the deal mechanism being coupled on a machine platen, each of the mahjong tiles having a rectangular shape and a face at a bottom thereof and being provided with an inner magnet therein extending in a long axis direction thereof, the inner magnet being disposed close to a top central portion of each mahjong tile, the mahjong tiles being shuffled evenly by the shuffle mechanism and conveyed out one by one through the deal mechanism; the shuffle mechanism comprising a front side frame, a rear side frame, and a cylinder having an opening at a front side thereof, a top end of the front side frame being provided with a front bearing seat, a top end of the rear side frame being provided with a rear bearing seat, a center of the cylinder being provided with a rotatable shaft, the rotatable shaft passing through a fluted disk disposed at a rear side of the cylinder, the rotatable shaft being connected between the front bearing seat and the rear bearing seat, the front side frame being provided with a front cover having a notch to cover the opening of the cylinder, the front cover being not in contact with the cylinder, the rear side frame being provided with a first motor to drive a first transmission belt fitted on the fluted disk to bring the cylinder to turn, a circumferential surface of the cylinder being formed with a plurality of spaced rectangular through holes, a long axis direction of the through holes being same as an axial direction of the cylinder, an outer side of each through hole being provided with a magnet assembly, the magnet assembly comprising a fixing member and a magnet wrapped by the fixing member and corresponding to the long axis direction of the through holes, the fixing member being coupled to the outer circumferential surface of the cylinder, the magnet corresponding to a respective one of the through holes to attract the inner magnet of one of the mahjong tiles in the cylinder, enabling the cylinder to bring the attracted mahjong tile to be turned, a base being provided beneath the front and rear side frames, the base being provided with a reed switch, the reed switch being located close to the cylinder to sense passing of the magnet assembly, the deal mechanism comprising an elongate bottom board, one side of the bottom board in a long axis direction thereof being provided with a tall side board, and another side of the bottom board being provided with a short side board, the bottom board being coupled on the machine platen, a second motor being coupled to an outer side of the tall side board to drive a conveying belt provided between the tall side board and the short side board, a front end of the deal mechanism passing through the notch of the cover and being inserted in the cylinder, enabling the deal mechanism to be located at an inner top end of the cylinder, the tall side board being not in contact with the cylinder, the mahjong tile attracted by the magnet assembly of the cylinder being brought to pass the short side board and be blocked by the tall side board to disengage from the magnet assembly and drop on the conveying belt.

2. The shuffle and deal device for mahjong tiles as claimed in claim 1, wherein an inner side wall of the cylinder is provided with oblique guide boards each disposed between every two of the through holes.

3. The shuffle and deal device for mahjong tiles as claimed in claim 1, wherein an inner side of the tall side board is provided with a smooth plate.

4. The shuffle and deal device for mahjong tiles as claimed in claim 1, wherein the conveying belt is to surround a drive wheel, an upper idle wheel, and a lower idle wheel, and the drive wheel is directly driven by the second motor.

5. The shuffle and deal device for mahjong tiles as claimed in claim 4, wherein the tall side board and the short side board are formed with corresponding oblique grooves, a tension pulley is connected between the oblique grooves and adjustable within the oblique grooves, and an outer side of the conveying belt passes around the tension pulley.

6. The shuffle and deal device for mahjong tiles as claimed in claim 4, wherein an outer side of the short side board is provided with a first outer gear, the first outer gear and the drive wheel are turned coaxially, through a second transmission belt, the first outer gear drives a second outer gear and a first helical gear coaxial with the second outer gear, the first helical gear meshes with a second helical gear, an upper end of the second helical gear is provided with a guide wheel, the guide wheel is coaxial with the second helical gear and driven synchronously, a tangential direction of rotation of the guide wheel is opposite to a forwarding direction of the conveying belt, the guide wheel protrudes out of a top end of the short side board, and a distance between an edge of the guide wheel and the tall side board is greater than a length in a short axis direction of the mahjong tiles but less than a length in the long axis direction of the mahjong tiles.

7. The shuffle and deal device for mahjong tiles as claimed in claim 4, wherein a leading board is provided over a rear end of the conveying belt, the leading board has a flared opening at a front end thereof, an exit is formed between the leading board and the conveying belt for the mahjong tiles, and a width of the exit of the leading board is greater than a length in a short axis direction of the mahjong tiles but less than a length in the long axis direction of the mahjong tiles.

* * * * *